US007716898B1

(12) United States Patent
Dunn

(10) Patent No.: US 7,716,898 B1
(45) Date of Patent: May 18, 2010

(54) PROTECTIVE REBAR COVER

(76) Inventor: Edmund M. Dunn, 7900 Old York Rd., #905A, Elkins Park, PA (US) 19027-2338

( * ) Notice: Subject to any disclaimer, the term of this patent is extended or adjusted under 35 U.S.C. 154(b) by 960 days.

(21) Appl. No.: 09/569,826

(22) Filed: May 12, 2000

(51) Int. Cl.
*E04C 5/07* (2006.01)

(52) U.S. Cl. ..... 52/689; 52/677; 52/679; 248/68.1; 248/49; 404/135

(58) Field of Classification Search ..... 52/301, 52/300, 289.1, 689, 677, 679, 687; 404/135, 404/136; 248/68.1, 49, 62
See application file for complete search history.

(56) References Cited

U.S. PATENT DOCUMENTS

| | | | | | |
|---|---|---|---|---|---|
| 4,202,378 | A | | 5/1980 | Bush et al. | |
| D262,093 | S | | 12/1981 | Bush | |
| 4,343,399 | A | * | 8/1982 | Patel et al. | 206/222 |
| 4,833,850 | A | | 5/1989 | Lunn | |
| 5,301,485 | A | * | 4/1994 | Shaw et al. | 52/678 |
| 5,313,757 | A | | 5/1994 | Schnepf | |
| 5,363,618 | A | | 11/1994 | Underwood | |
| 5,381,636 | A | | 1/1995 | Kassardjian et al. | |
| 5,447,290 | A | | 9/1995 | Workman | |
| D363,657 | S | | 10/1995 | Kassardjian et al. | |
| 5,469,679 | A | * | 11/1995 | Burkard et al. | 52/301 |
| 5,523,043 | A | * | 6/1996 | Kassardjian et al. | 264/273 |
| 5,568,708 | A | | 10/1996 | Kassardjian et al. | |
| 5,613,336 | A | | 3/1997 | Workman | |
| 5,729,941 | A | * | 3/1998 | Kassardjian et al. | 52/301 |
| 5,824,253 | A | * | 10/1998 | Kassardjian et al. | 264/275 |
| 5,884,443 | A | * | 3/1999 | Schimmelpfennig et al. | 52/301 |
| D408,268 | S | | 4/1999 | Dunn | |
| 5,943,836 | A | * | 8/1999 | Kassardjian | 52/301 |
| 5,946,871 | A | * | 9/1999 | Kassardjian et al. | 52/301 |
| 5,950,680 | A | * | 9/1999 | Randall | 138/96 R |
| 6,073,415 | A | * | 6/2000 | Carnicle | 52/698 |
| 6,085,478 | A | * | 7/2000 | Workman | 52/301 |

FOREIGN PATENT DOCUMENTS

| | | | | |
|---|---|---|---|---|
| JP | 331028 | * | 12/1998 | 428/14 |
| WO | WO091/14839 | | 10/1991 | |

OTHER PUBLICATIONS

J. A. Brydson, Plastics Materials Jan. 1999, Butterworth Heinemann, Seventh Edition, p. 238.*

J.A. Brydson, Plastics Materials Jan. 1999, Butterworth Heinemann, Seventh Edition, p. 238 Don De Cristo Concrete Accessories, Inc. Catalog "Plastic Rebar Guard", p. 43. Deslauriers Impalement Protective "Safety Cap Disc System" Buffalo American Allsafe Company "Bargard" Mutual Industries Inc. OSHA Rebar Caps Part No. 14640-4 and 14640-5.

* cited by examiner

*Primary Examiner*—Phi Dieu Tran A
(74) *Attorney, Agent, or Firm*—Joseph E. Mueth

(57) ABSTRACT

A rebar safety protective cover for use on the projecting free end of concrete reinforcing bar to prevent impact injuries comprising:

(a) a hollow cylindrical body closed at one end and open at the other, (b) a flat overhanging impact head of substantial extent projecting laterally outwardly beyond said closed end of the body, said body and impact head being of a thickness and integrally formed of a plastic material to provide a protective cover which passes the Cal OSHA drop test when the rebar is positioned within said protective cover at an angle such that the free end of the rebar abuts the inside lateral extremity of said closed end.

12 Claims, 3 Drawing Sheets

PROTECTIVE REBAR COVER

BACKGROUND OF INVENTION

Steel reinforcing bars ("rebar") have long been used in reinforced concrete in building structures. During the construction of buildings, it is often the case that the ends of the rebar are exposed and extend upwardly from a recently poured concrete section or wall. These exposed ends are sharp and present a hazard to workmen, particularly to workmen working overhead to place forms and pour fresh concrete. Many workmen have sustained puncture injuries, and in a significant number of cases have been killed, due to accidentally falling onto the exposed ends of the rebar.

Various protective safety covers have been proposed and used over the last 20 years to protect workmen from this hazard. Bush U.S. Pat. No. 4,202,378 and Bush Design Patent Number 262,093 refer to a protective safety cover for use on the free projecting ends of rebar comprising a hollow cylindrical body of a deformable plastic material, the body being closed at one end and open at the other. A plurality of inwardly extending projections are formed within the open end of the cylindrical body to secure the protective cover to the rebar. The closed end of the body has a flat circular head which extends radially outwardly from the body to present an enlarged flat impact surface. Other plastic protective covers for rebar are discussed in Schimmelpfenning U.S. Pat. No. 5,884,443 and Don De Cristo Concrete Accessories Inc. Catalog "Plastic Rebar Guard", p. 43. Lunn U.S. Pat. No. 4,833,850 proposed a protective cover for rebar in the form of a metal support adapted to hold a impact absorbing spherical cushion.

When it was realized that these all plastic protective covers were subject to penetration upon severe impact, such as a workman falling from a height, it was proposed to insert a separate piece of rebar through lateral holes near the closed end of the cylindrical body to provide for a steel stop as discussed in WO91/14839 and Underwood U.S. Pat. No. 5,363,618. This approach is not self-contained, is inconvenient, and subject to not being consistently practiced.

Consequently, protective covers having a built in metal plate or "seat" in the bottom of the closed end of the body were developed. Protective covers of this type are discussed in Schnepf U.S. Pat. No. 5,313,757, Workman U.S. Pat. Nos. 5,447,290 and 5,613,336, Deslauriers Impalement Protective "Safety Cap DISC System", Buffalo American Allsafe Company "Bar Gard", Mutual Industries Inc. OSHA Rebar Cups Part Numbers 14640-4 and 14640-5, Dunn U.S. Design Pat. No. 408,268, and Kassardjian et al U.S. Pat. Nos. 5,381,636, 5,523,043, 5,568,708, 5,824,253, 5,943,836, 5,946,871 and Design No. 363,657. Protective covers with metal plates or seats passed the original Cal OSHA drop test.

However, after an investigation of job site injuries, Cal OSHA subsequently declared that the existing protective covers with metal plate or seat were inadequate, primarily due to being subject to penetration through the side of the cylindrical body upon impact on the head, resulting in serious puncture injuries to workmen falling onto the rebar.

Cal OSHA has recently announced a new and more stringent drop test which all new rebar protective covers will be required to meet. Kassardjian et al U.S. Pat. No. 5,729,941 relates to a rebar cover having a bowl-shaped metal seat incorporated in the closed inner end of the cylindrical body which is claimed to prevent penetration of the rebar through the side of the cover body upon impact.

SUMMARY OF INVENTION

This invention comprises a rebar safety protective cover for use on the projecting free end of concrete reinforcing bar to prevent impact injuries comprising:

(a) a hollow cylindrical body closed at one end and open at the other, (b) a flat overhanging impact head of substantial extent projecting laterally outwardly beyond said closed end of the body, said body and impact head being of a thickness and integrally formed of a plastic material to provide a protective cover which passes the Cal OSHA drop test when the rebar is positioned within said protective cover at an angle such that the free end of the rebar abuts the inside lateral extremity of said closed end.

The invention further comprises a rebar used to reinforce concrete wherein the rebar has an exposed free end and a safety protective cover is present on said exposed free end, said protective cover comprising:

(a) a hollow cylindrical body closed at one end and open at the other, (b) a flat overhanging impact head of substantial extent projecting laterally outwardly beyond said closed end of the body, said body and impact head being of a thickness and integrally formed of a plastic material to provide a protective cover which passes the Cal OSHA drop test when the rebar is positioned within said protective cover at an angle such that the free end of the rebar abuts the inside lateral extremity of said closed end.

The protective cover of this invention is integrally molded, in standard plastic injection molding equipment, of a high molecular weight polyolefin polymers. No reinforcing members or materials, or seat elements are required. Normally, the plastic does contain a small amount (about 0.04%) of an orange colorant such as anti-UV red, a small amount of orange pigment (about 0.032%) and a small amount of filler such as calcium chloride (about 1% to 3%), all based on the total weight of polymers. These additives are desirable, but not essential.

DESCRIPTION OF PREFERRED EMBODIMENTS

In my preferred embodiment, the protective cover is injection molded of a homogenous mixture of two very high molecular weight polyethylene polymers as follows:

| Polymer | Molecular Weight Distribution | Density gTcm$^3$ | Percentage By Weight |
|---|---|---|---|
| Extra High Molecular Weight High Density Polyethylene | about $2.5 \times 10^5$ to about $15 \times 10^5$ | about 0.945 | about 95% |
| Ultra High Molecular Weight High Density Polyethylene | essentially all over about $15 \times 10^5$ | about 0.97 | about 5% |

The upper limit of the molecular weight of the ultra high molecular weight high density polytheylene is not critical. Such polymers currently available are believed to be only slightly above $15\times10^5$ but could be higher such as 20 or $25\times10^5$.

The two polymers are premixed and colorant, pigment and filler are added. A homogenous blend forms in the molten state which is then injected into the cavity of the mold. Injection molding equipment is used to form the protective cover to the desired shape.

Turning to the drawings.

Figure 1:
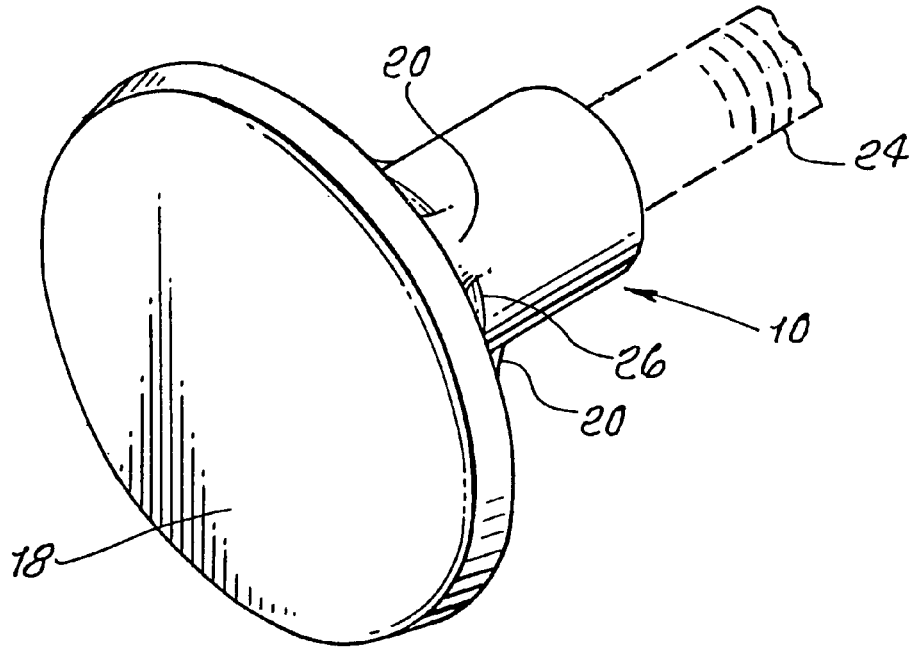
FIG. 1 is a perspective view of the protective cover of this invention position when over the rebar. The rebar is shown in dotted lines to indicate it is longitudinally aligned within the protective cover.

The hollow cylindrical body 10 is closed at one end 12 and is open at the other 14. The lateral extremity of the closed end of the cylindrical body 10 is indicated by 16. The flat overhanging impact head 18 is integrally formed with the cylindrical body 10.

The impact head 18 as shown is circular and has an area of about 16 square inches as required by Cal OSHA. The impact head can also be square.

Four web-like buttresses 20, spaced at a 90° interval, help support the periphery of the impact head 18 around its underside.

The inside flanges 22 serve to keep the protective cover longitudinally aligned with the rebar 24 by gripping the sides of the rebar.

The exterior of the wall of the cylindrical body 10 is thickened adjacent its closed end 12, as indicated at 26. The thickened exterior wall area 26 forms an annular ring around the base of the cylindrical body 10. In the preferred embodiment, this annular ring normally has a height of from about 2.65 centimeters, measuring from the upper surface of the impact head 18 of the protective cover. The radial thickness of the wall area 26 is about 0.5 to about 0.6 centimeters.

Figure 2:
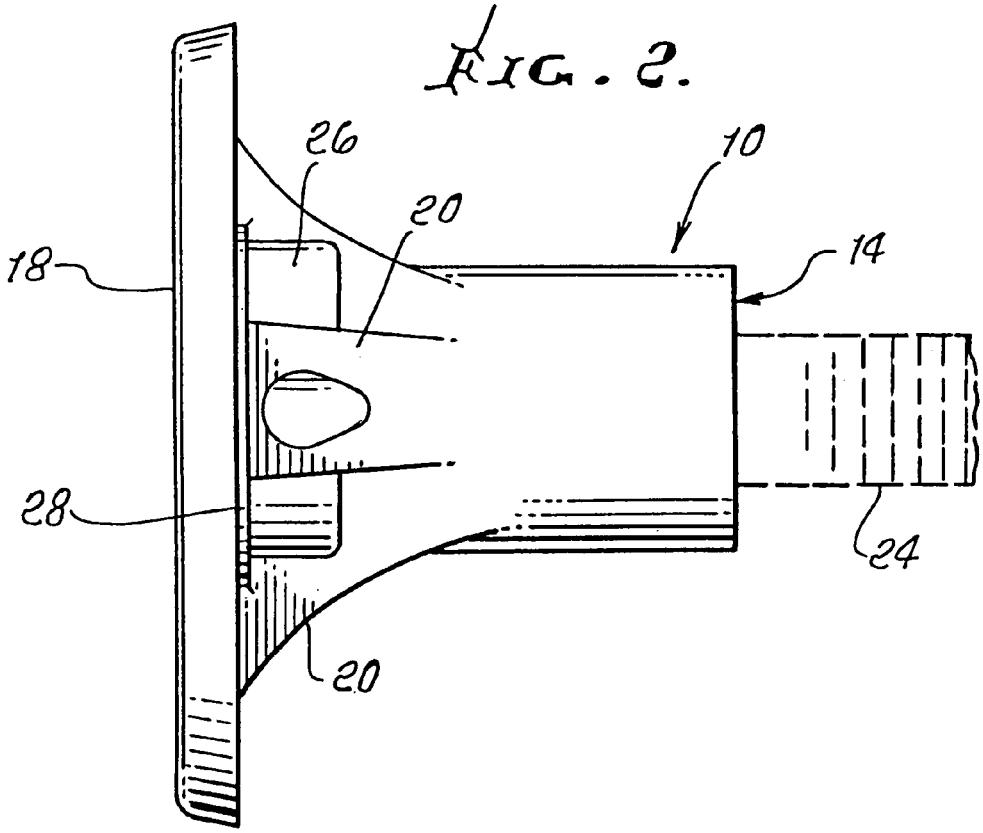
FIG. 2 is a side view of the protective cover of FIG. 1.
Figure 3:
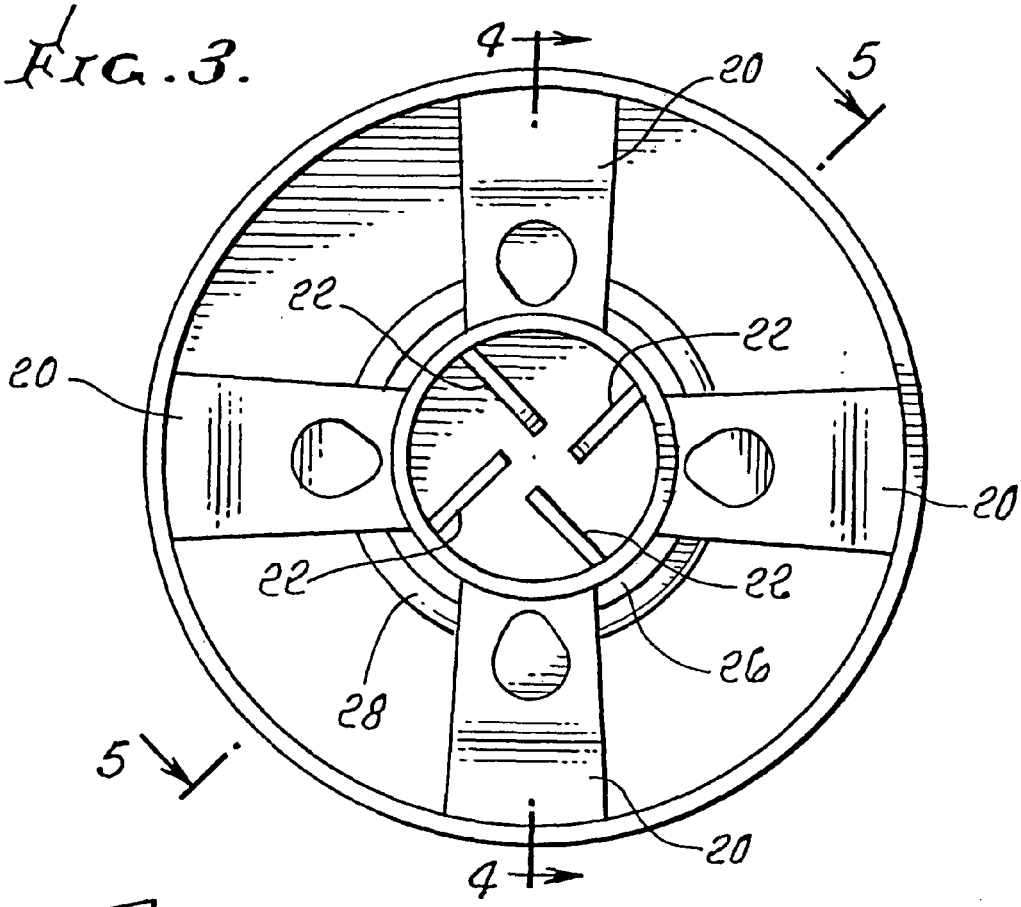
FIG. 3 is a view from the open end of the cylindrical body portion shown in FIGS. 1 and 2.
Figure 4:
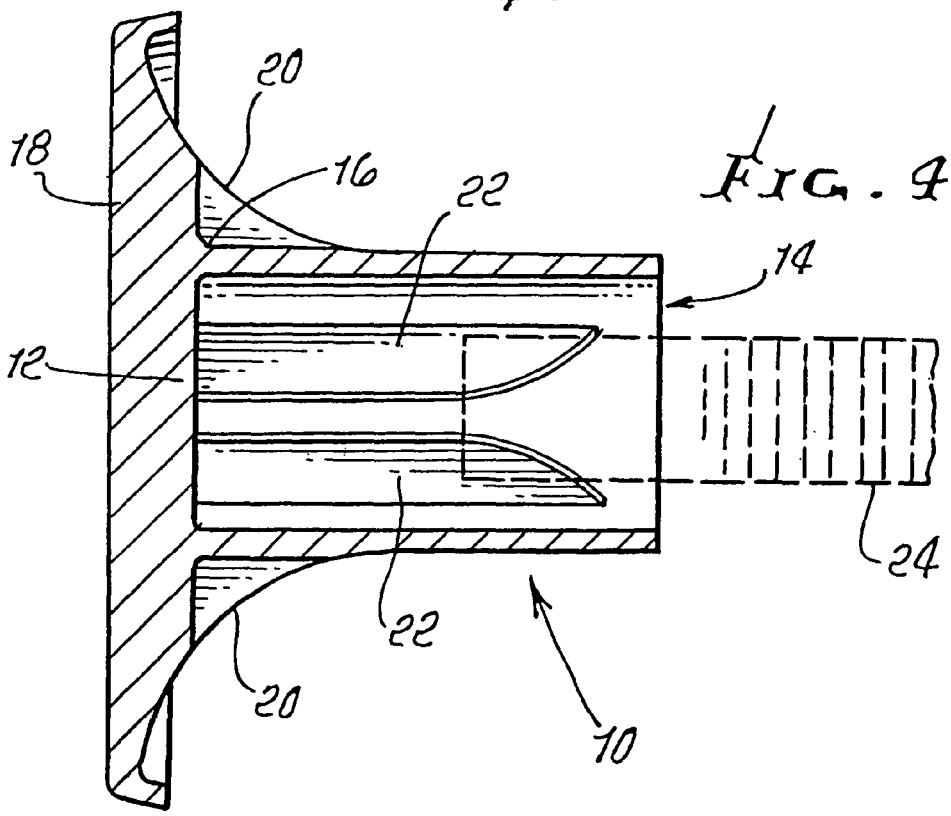
FIG. 4 is a sectional view taken along the lines 4-4 in FIG. 3.

The upper surface of the impact head of the protective cover is preferably flat as shown in FIGS. 1, 2 and 4. However, a domed or mushroom shaped upper surface is also acceptable.

Figure 5:
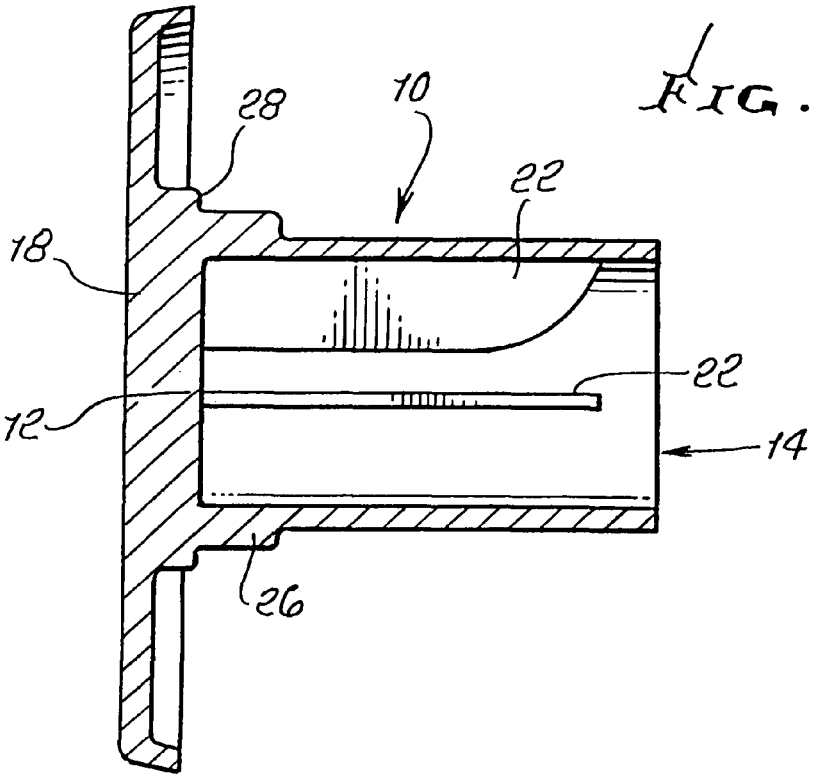
FIG. 5 is a sectional view later along the lines 5-5 in FIG. 3.

The impact head 18 is thickened at the closed end 12 of the cylindrical body 10 as indicated at 28. The thickened portion 28 extends radially outwardly beyond the exterior wall of the cylindrical body 10 as shown in FIGS. 2, and 5.

The thickened portion 28 is normally from about 1.0 to about 1.5 centimeters, preferably about 1.25 centimeters, in thickness, measured from the inside of the closed end of the protective cover to the flat upper surface of the impact head.

The original Cal OSHA drop test required the protective cover be capable of withstanding at least the impact of a 250 pound weight dropped from a height of 10 feet din without penetration failure of the cover. This drop test was based on the rebar being aligned with the longitudinal dimension of the cylindrical body portion.

The problem is that the prior protective covers in actual use, upon impact, allowed the rebar to penetrate and pierce the side of the cylindrical body at or around its junction with the impact head. Failures of this kind have resulted in serious industrial accidents.

Figure 6:
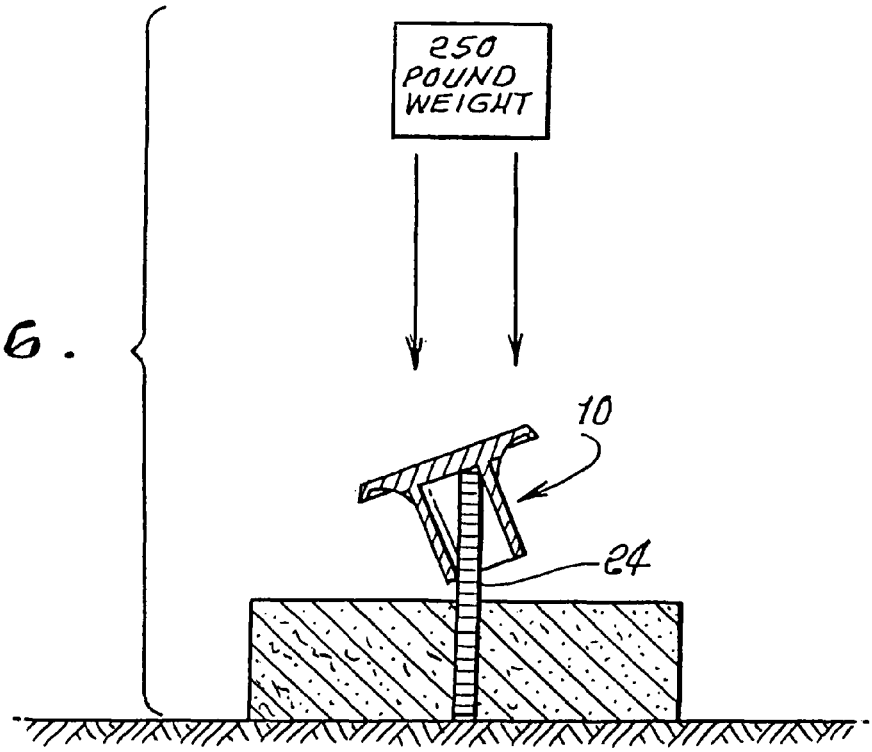
FIG. 6 shows the positioning of the protective cover on the rebar at the maximum possible angle, as required by the proposed new Cal OSHA drop test. The free end of the rebar abuts the inside of the cylindrical body portion at the lateral extremity of the closed end of the cylindrical body portion.

Since it was found upon severe impact that the interior flanges 22 would break or give way, allowing the protective cover to become cocked at an angle to the rebar, the latest Cal OSHA drop test requires that it be conducted with the protective cover positioned over the rebar as shown in FIG. 6.

The following test results demonstrated the efficacy of the rebar safety protective cover of this invention.

Cal OSHA Drop Test

Test Procedure:

The drop test was conducted in accordance with the latest Cal OSHA procedure. The plastic rebar protective cover of this invention was attached to the sheared end of a 24 inch long #4 rebar. The rebar was rigidly held in a vertical position during impact. A test weight was suspended above the test item at the specified drop height of 10 feet, as measured from the bottom of the test weight to the top of the test item. The test weight consisted of 250 pounds of dry sand in a Kevlar bag. The test weight was slowly raised to the specified drop height. When the test weight reached the specified drop height, the test weight was quickly released by cutting the support wire cable. The test weight then impacted the test item. The test item was then visually inspected for evidence of physical damage. Three (3) drops were conducted: The first drop was conducted with the plastic rebar protective cover of this invention installed squarely on the rebar. The second and third drops were performed with the plastic stabilizer flanges 22 removed from the rebar protective cover of this invention. This allowed the rebar protective cover to sit on the rebar at maximum angle out of level. A drawing of this set-up may be seen in FIG. 6. The free end of the rebar abutted the inside of the cylindrical body portion at its lateral extremity.

Test Data:

Test Weight: 250 pounds

Drop Height: 10 feet

Test Results:

The plastic rebar caps completed the drop tests with no evidence of cracking and/or splitting.

These results indicate that the rebar protective cover of this invention is likely to be more effective in preventing serious puncture injuries to workmen accidentally falling on the end of exposed rebar.

What is claimed is:

1. A rebar safety protective cover for use on the projecting free end of concrete reinforcing bar to prevent impact injuries consisting of:

(a) a hollow cylindrical body closed at one end and open at the other, (b) an overhanging impact head of substantial extent projecting laterally outwardly beyond said closed end of the body, said body and impact head being of a thickness and integrally formed of a plastic material to provide a protective cover which passes the Cal OSHA drop test when the rebar is positioned within said protective cover in direct contact with said plastic material and at an angle such that the free end of the rebar abuts the inside diametrical lateral extremity of said closed end.

2. A rebar safety protective cover for use on the projecting free end of concrete reinforcing bar to prevent impact injuries consisting essentially of:

(a) a hollow cylindrical body closed at one end and open at the other, (b) an overhanging impact head of substantial extent projecting laterally outwardly beyond said closed end of the body, said body and impact head being of a thickness and integrally formed of a high density plastic material to provide a protective cover which passes the Cal OSHA drop test when the rebar is positioned within said protective cover in direct contact with said plastic material and at an angle such that the free end of the rebar abuts the inside diametrical lateral extremity of said dosed end and wherein the plastic material is a mixture of polyethylenes, one having molecular weight in the range from about $2.5\times10^5$ to about $15\times10^5$ and another a molecular weight in the range above about $15\times10^5$, said rebar safety protective cover being free of a metal seat.

3. A rebar safety protective cover for use on the projecting free end of concrete reinforcing bar to prevent impact injuries consisting essentially of:

(a) a hollow cylindrical body closed at one end and open at the other, (b) an overhanging impact head of substantial extent projecting laterally outwardly beyond said closed end of the body, said body and impact head being of a thickness and integrally formed of a high density plastic material to provide a protective cover which passes the Cal OSHA drop test when the rebar is positioned within said protective cover in direct contact with said plastic material and at an angle such that the free end of the rebar abuts the inside diametrical lateral extremity of said closed end, said cylindrical body having an exterior wall with a radially extending annular ring surrounding and thickening said wall at said closed end, said rebar safety protective cover being free of a metal seat.

4. The rebar safety protective caps of claim 3 wherein the plastic material is a mixture of polyethylenes, one having a molecular weight in the range from about $2.5\times10^5$ to about $15\times10^5$, and another a molecular weight in the range above about $15\times10^5$.

5. The rebar safety protective cover of claim 4 wherein polyethylene has a density of about 0.945 and the other polyethylene a density of about 0.97.

6. The rebar safety protective cover of claim 3 wherein the first mentioned polyethylene is present in a weight amount of about 95% and the second mentioned in a weight of about 5%.

7. A rebar safety protective cover for use on the projecting free end of concrete reinforcing bar to prevent impact injuries consisting essentially of:

(a) a hollow cylindrical body closed at one end and open at the other, (b) an overhanging impact head of substantial extent projecting laterally outwardly beyond said closed end of the body, said body and impact head being of a thickness and integrally formed of a high density plastic material to provide a protective cover which passes the Cal OSHA drop test when the rebar is positioned within said protective cover in direct, contact with said plastic material and at an angle such that the free end of the rebar abuts the inside diametrical lateral extremity of said closed end, said rebar safety protective cover being free of a metal seat.

8. The rebar safety protective caps of claim 7 wherein the plastic material is a mixture of polyethylenes, one having a density of about 0.945 and another of about 0.97.

9. The rebar safety protective caps of claim 8 wherein the first mentioned polyethylene is present at about 95 weight percentage and the other at about 5 weigh percent.

10. The rebar safety protective cover of claim 7 wherein said cylindrical body has a cylindrical wall with a radially extending annular ring surrounding and thickening said wall at said closed end.

11. The rebar safety protective cover of claim 7 wherein said impact head has a flat outer surface for receiving impact.

12. The combination of a rebar used to reinforce concrete wherein the rebar has an exposed free end and a safety protective cover is present on said exposed free end, said protective cover consisting essentially of:

(a) a hollow cylindrical body closed at one end and open at the other, (b) an overhanging impact head of substantial extent projecting laterally outwardly beyond said closed end of the body, said body and impact head being of a thickness and integrally formed of a high density plastic material to provide a protective cover which passes the Cal OSHA drop test when the rebar is positioned within said protective cover in direct contact with said plastic material and at an angle such that the free end of the rebar abuts the inside diametrical lateral extremity of said closed end, said rebar safety protective cover being free of a metal seat.

* * * * *